US005570069A

United States Patent [19]

Franke

[11] Patent Number: 5,570,069

[45] Date of Patent: Oct. 29, 1996

[54] BROADBAND DIRECTIONAL COUPLER

[75] Inventor: Earnest A. Franke, Largo, Fla.

[73] Assignee: E-Systems, Inc., Dallas, Tex.

[21] Appl. No.: 486,381

[22] Filed: Jun. 7, 1995

Related U.S. Application Data

[63] Continuation of Ser. No. 235,922, May 2, 1994, abandoned.

[51] Int. Cl.[6] ..... H01P 5/18

[52] U.S. Cl. ..... 333/115; 333/116

[58] Field of Search ..... 333/109, 112, 333/115, 116

[56] References Cited

U.S. PATENT DOCUMENTS

| | | | |
|---|---|---|---|
| 3,600,707 | 8/1971 | Friedman . | |
| 3,723,913 | 3/1973 | Seidel . | |
| 4,127,831 | 11/1978 | Riblet | 333/116 X |
| 4,216,446 | 8/1980 | Iwer | 333/116 X |
| 4,419,635 | 12/1983 | Reindel | 333/116 |
| 4,814,780 | 3/1989 | Sterns et al. | 343/756 |
| 5,075,646 | 12/1991 | Morse | 333/116 |

*Primary Examiner*—Paul Gensler
*Attorney, Agent, or Firm*—Harold E. Meier

[57] ABSTRACT

A directional coupler having a broadband frequency response comprises a pair of parallel TEM transmission lines having an input port, a thru port, a coupled port, and an isolation port. A quarter-wave, short circuited transmission line coupled to the thru port, and a half-wave, open circuited transmission line coupled to the isolation port functions to flatten the frequency response between the input port and the thru port and between the input port and the coupled port and to increase the operating bandwidth of the directional coupler.

12 Claims, 3 Drawing Sheets

BROADBAND DIRECTIONAL COUPLER

This is a continuation of application Ser. No. 08/235,922, filed May 2, 1994, abandoned.

TECHNICAL FIELD

This invention relates to directional couplers, and more particularly to a directional coupler including compensating networks for increasing operational bandwidth.

BACKGROUND OF THE INVENTION

The basic directional coupler is a linear, passive, four port network, consisting of a pair of coupled transmission lines. A first transmission line defines an input port and a thru port, and a second transmission line defines a coupled port and an isolation port. Propagation of a signal applied to the input port along the first transmission line induces the propagation of a coupled signal along the second transmission line. Maximum signal coupling between the pair of coupled transmission lines is achieved when the length of the coupling region is an odd multiple of a quarter wavelength. Because signal coupling is dependent on the signal wavelength, existing directional couplers are narrowly limited to a specific bandwidth. The ability to increase the operational bandwidth of a directional coupler would greatly increase the benefits of presently existing couplers and broaden their applications into other areas.

SUMMARY OF THE INVENTION

The present invention overcomes the foregoing and other problems with directional couplers by connecting a pair of compensation networks to the coupler. The first compensation network comprises a closed circuited, quarter-wave transmission line coupled to the thru port of the coupler. The second compensation network comprises an open circuited, half-wave transmission line coupled to the isolation port of the coupler. The included compensation networks function to flatten the frequency response of the coupler between the input port and the coupled port, and between the input port and the thru port. This allows the directional coupler to have a broader operational bandwidth than was previously available with prior art directional couplers.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
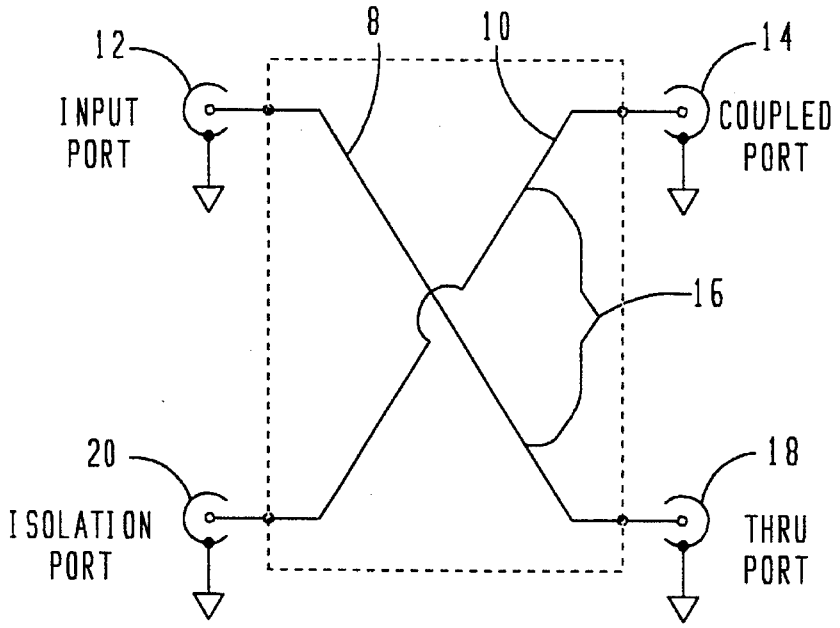
FIG. 1 ( PRIOR ART )
FIG. 1 is a schematic diagram of a prior art uncompensated directional coupler.

Referring now to the Drawings, and more particularly to FIG. 1, there is shown a schematic representation of a prior art uncompensated directional coupler. The uncompensated directional coupler comprises two parallel, adjacent transverse-electromagnetic mode (TEM) transmission lines (8 and 10) defining four ports. The input port 12 receives an input signal from an external source (not shown) for propagation along transmission line 8 to the thru port 18. The coupled port 14 emits a coupled signal induced along the transmission line 10. The coupled signal is induced within the coupling region 16 of the directional coupler. The signal emitted from the thru port 18 has a power value equal to the power value of the signal received at the input port 12, minus the power value of the coupled signal emitted from the coupled port 14. This power value relationship at thru port 18 signal assumes an ideal, lossless structure for the coupler. In reality, the power value at the thru port 18 would also be reduced by line losses within the transmission lines (8 and 10). The isolation port 20 at the opposite end of the transmission line 10 from the coupled port 14 emits no signal. Reflected energy, due to impedance mismatches at either output port, appears at the isolation port 20. This isolation port 20 is normally terminated by the characteristic coupler impedance of 50 ohms.

Figure 2:
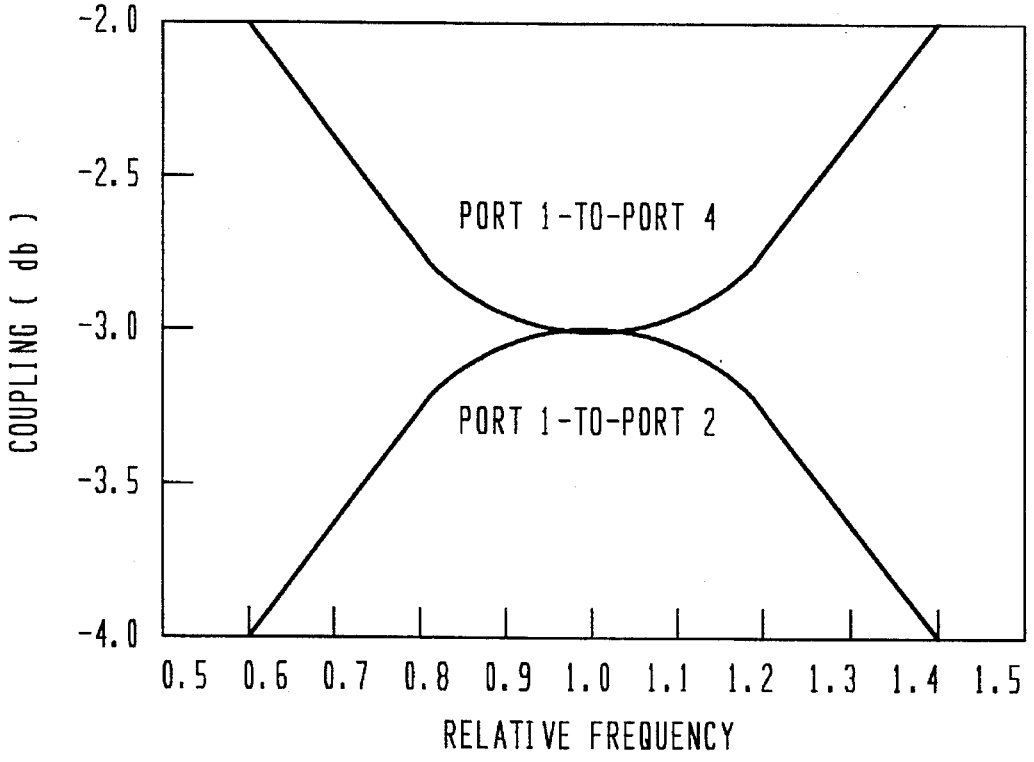
FIG. 2 ( PRIOR ART )
FIG. 2 is a diagram of the frequency response of the prior art uncompensated, equal power split directional coupler.

Referring now to FIG. 2, there is illustrated the frequency response for the uncompensated directional coupler of FIG. 1 designed to have a midband coupling of 3.0 dB at 1 GHz. Assuming the coupler allowed a coupling deviation between the two output ports of only ±0.2 dB (0.4 dB), the relative frequency response would only extend from approximately 0.83 GHz to approximately 1.18 GHz.

Figure 3:
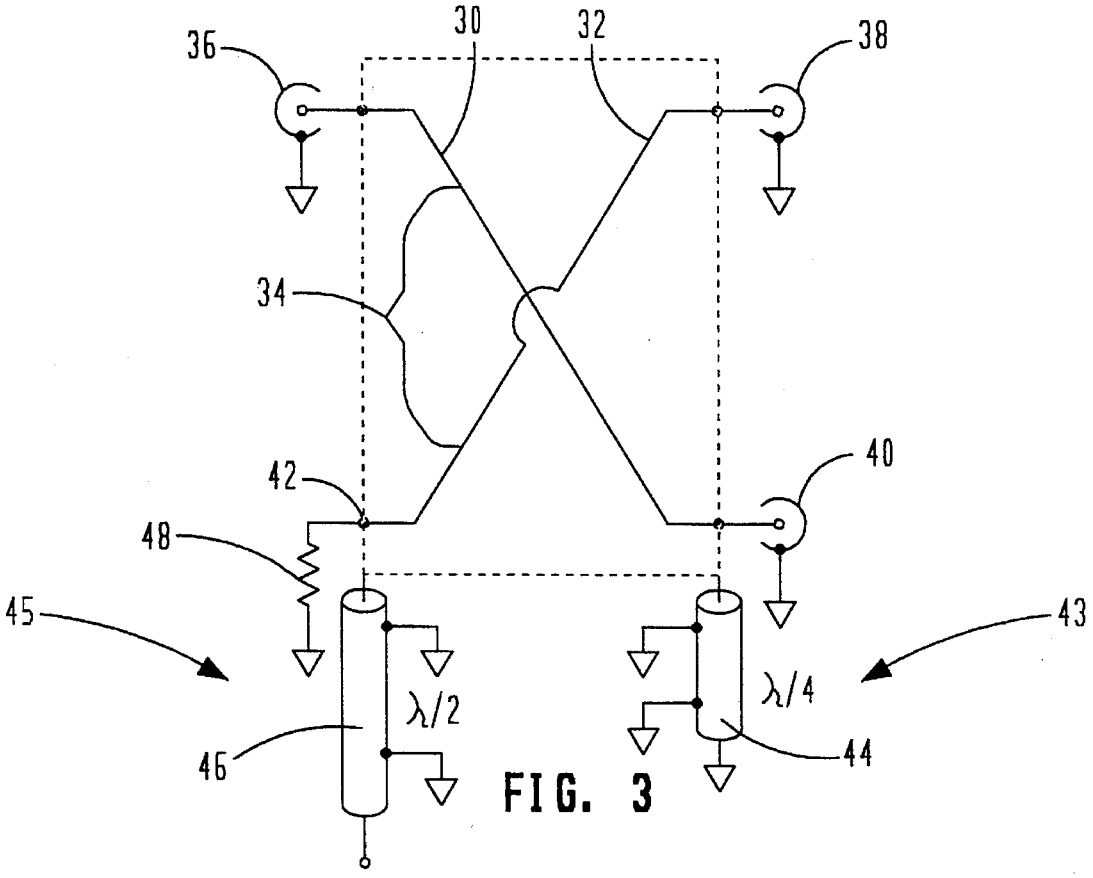
FIG. 3 is a schematic diagram of a compensated directional coupler of the present invention.
Figure 4:
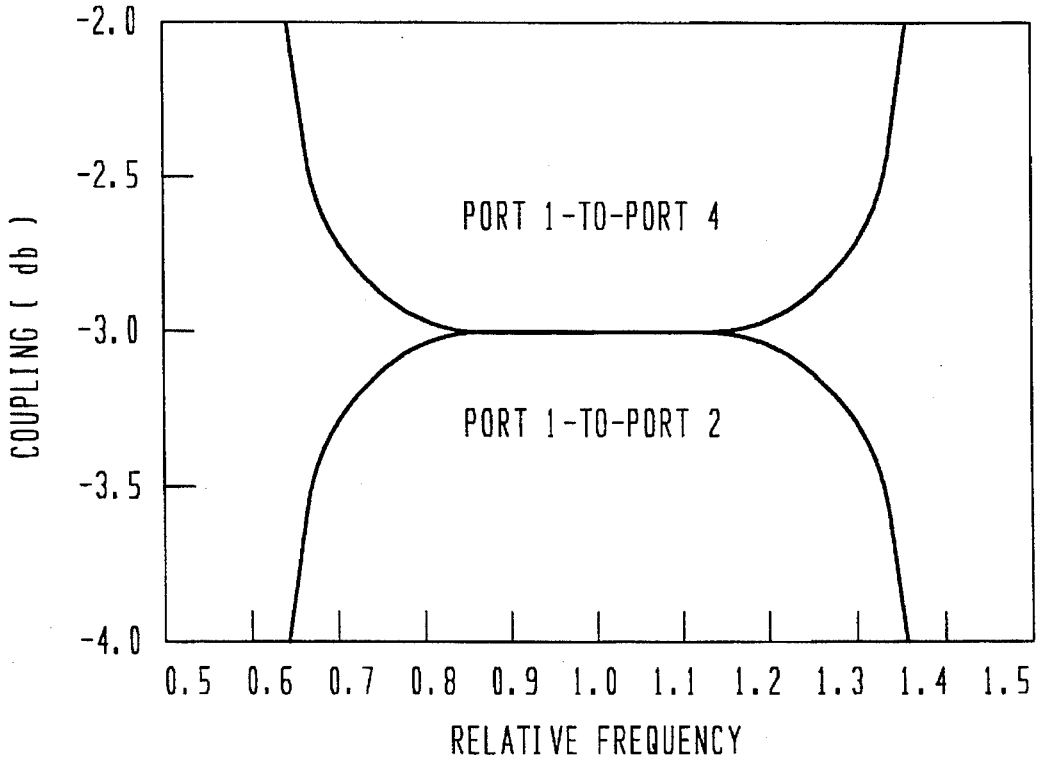
FIG. 4 is a diagram of the frequency response of the compensated directional coupler of FIG. 3.

Referring now to FIG. 3, there is shown a schematic drawing of a compensated directional coupler of the present invention. Two parallel TEM transmission lines, 30 and 32, are coupled together over a coupling region 34. The input port 36, coupled port 38, thru port 40 and isolation port 42 are the same as those described with respect to FIG. 1. The compensated directional coupler further includes two compensating networks. The first compensating network 43 comprises a quarter-wave, short circuited transmission line 44 coupled to the thru port 40. This first compensation network principally affects the input port 36 to thru port 40 coupling. The second compensating network 45 comprises a half-wave, open circuited transmission line 46 connected to the isolation port 42. The termination resistor 48 is normally attached to the directional coupler isolation port 42 to absorb mismatch energy. This second compensation network serves to flatten the coupling response between the input port 36 and the coupled port 38. The net result of the two compensation networks is illustrated in FIG. 4, wherein the relative frequency response demonstrates equal coupling over a greater frequency range from the compensated coupler as compared to the uncompensated coupler.

Referring now to TABLE 1, there is illustrated a comparison of the relative frequency response of a compensated directional coupler of the present invention (FIG. 3) versus an uncompensated directional coupler (FIG. 1) as a function of allowable output port amplitude imbalance. The response at the UHF band (225 to 400 MHz, $F_c$=312.5 MHz) is also shown. As can be seen from TABLE 1, at a typical design imbalance of 0.25 dB, the compensated coupler frequency response is flat from 233 to 392 MHz, whereas the conventional coupler only performs between 266 and 359 MHz.

TABLE 1

| Port-to-Port Amplitude Imbalance | Conventional Directional Coupler (FIG. 1) | | Compensated Directional Coupler (FIG. 3) | |
|---|---|---|---|---|
| (Coupled-to-Thru Port Difference | Relative Frequency Range | UHF Frequency Range | Relative Frequency Range | UHF Frequency Range |
| 0.05 dB | 0.932 to 1.068 | 291 to 334 MHz | 0.800 to 1.200 | 250 to 375 MHz |
| 0.10 dB | 0.905 to 1.095 | 283 to 342 MHz | 0.780 to 1.220 | 244 to 381 MHz |
| 0.15 dB | 0.880 to 1.120 | 275 to 350 MHz | 0.765 to 1.235 | 239 to 386 MHz |
| 0.20 dB | 0.865 to 1.135 | 270 to 355 MHz | 0.755 to 1.245 | 236 to 389 MHz |
| 0.25 dB | 0.850 to 1.150 | 266 to 359 MHz | 0.745 to 1.255 | 233 to 392 MHz |
| 0.30 dB | 0.834 to 1.166 | 261 to 364 MHz | 0.736 to 1.264 | 230 to 395 MHz |
| 0.35 dB | 0.820 to 1.180 | 256 to 369 MHz | 0.729 to 1.271 | 228 to 397 MHz |
| 0.40 dB | 0.809 to 1.191 | 253 to 372 MHz | 0.723 to 1.277 | 226 to 399 MHz |
| 0.45 dB | 0.896 to 1.204 | 249 to 376 MHz | 0.716 to 1.284 | 224 to 401 MHz |
| 0.50 dB | 0.786 to 1.214 | 246 to 379 MHz | 0.710 to 1.290 | 222 to 403 MHz |

Figure 5:
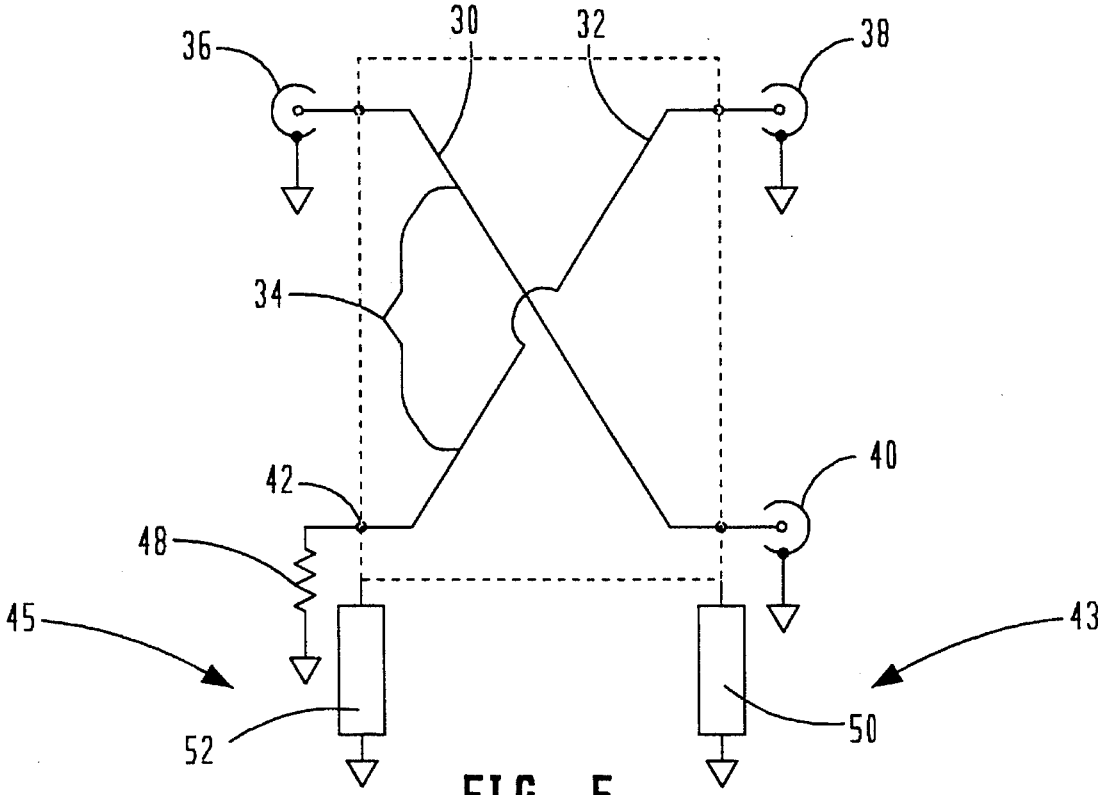
FIG. 5 is an alternative embodiment of a compensated directional coupler.

Referring now to FIG. 5, there is illustrated an alternative embodiment of a compensated directional coupler of the present invention utilizing lumped constant equivalent circuits in place of the quarter-wave and half-wave transmission lines. The basic directional coupler parallel transmission line and input ports are the same as those described with respect to FIG. 3, and similar reference numerals have been utilized. Instead of a quarter-wave short-circuited transmission line 44, a short-circuited, lumped constant equivalent network 50 is connected to the thru port 40. In place of the half-wave, open-circuited transmission line 46, an open circuited, lumped constant equivalent network 52 is connected to the isolation port 42. The lumped constant equivalent networks comprise two port networks composed of inductors and capacitors that emulate a transmission line.

Figure 6A:
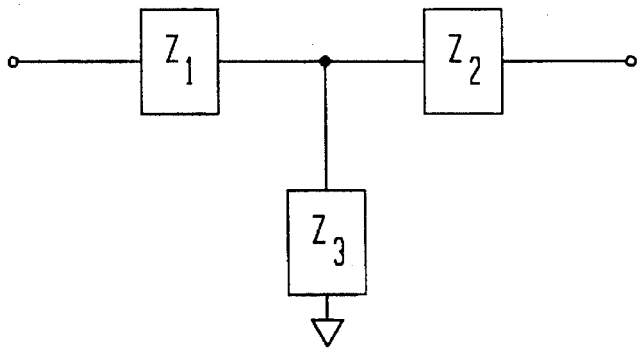
FIGS. 6A and 6B are illustrations of a T-shaped and a π-shaped lumped constant network, respectively, used in the alternative embodiment of FIG. 5.
Figure 6B:
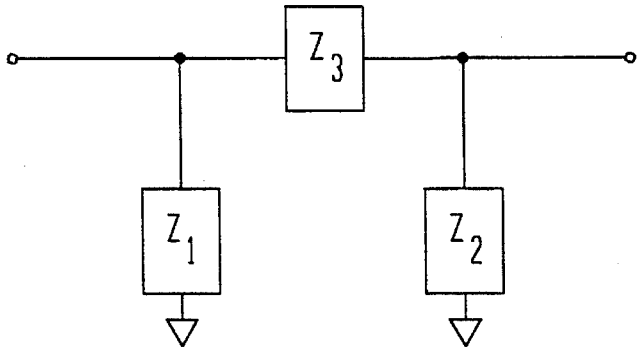

FIGS. 6A and 6B illustrate simple lumped constant equivalent networks using a T-shaped or a π-shaped network. In each of the π-shaped and T-shaped networks, the blocks $Z_1$, $Z_2$ and $Z_3$ will be comprised of inductors or capacitors to achieve the desired transmission line representation. To determine the values for $Z_1$, $Z_2$ and $Z_3$, the input characteristic impedance $R_1$ is set equal to the output characteristic impedance $R_2$, such that the network is symmetric and $R_1=R_2=R$. For most applications the characteristic impedance will equal 50 ohms.

For a T-shaped artificial transmission line equivalent network:

$$Z_1 = Z_2 = \frac{-j(R\cos\Theta - R)}{\sin\Theta} \quad (1)$$

$$Z_3 = \frac{-jR}{\sin\Theta} \quad (2)$$

where: θ equals the equivalent electrical length of the transmission line.

For a π-shaped artificial transmission line equivalent network:

$$Z_1=Z_2=j(R^2\sin\Theta)/(R\cos\Theta-R) \quad (1)$$

$$Z_3=jR\sin\theta \quad (2)$$

Each of the above described π-shaped and T-shaped artificial transmission line equivalent networks create an equivalent quarter-wave transmission line. To achieve the equivalent half-wave, open circuited transmission line two π-shaped or T-shaped networks would be cascaded together.

Although preferred embodiments of the present invention has been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A compensated backward-wave broadband directional coupler comprising:

a first transmission line defining an input port and having a thru port on one side of the coupler;

a second transmission line defining a coupled port and an isolation port and positioned adjacent to the first transmission line, the isolation port on a side of the coupler opposite from the thru port, whereby a signal propagating along the first transmission line induces a coupled signal for propagation along the second transmission line;

a quarter-wave, short circuited transmission line coupled to the thru port of the first transmission line; and a half-wave, open circuited transmission line coupled to the isolation port of the second transmission line said quarter-wave transmission line and said half-wave transmission line coupled to opposite sides of the coupler thereby increasing the operating bandwidth of the directional coupler.

2. The directional coupler of claim 1, wherein the first and second transmission lines are TEM transmission media.

3. The directional coupler of claim 1, wherein the first lumped constant network comprises a π-shaped lumped constant network.

4. The directional coupler of claim 1, wherein the first lumped constant network comprises a T-shaped lumped constant network.

5. The directional coupler of claim 1, wherein the second lumped constant network comprises a π-shaped lumped constant network.

6. The directional coupler of claim 1, wherein the second lumped constant network comprises a T-shaped lumped constant network.

7. A broadband directional coupler, comprising:

a first transmission line defining an input port and a thru port;

a second transmission line defining a coupled port and an isolation port and positioned adjacent to the first transmission line, whereby a signal propagating along the first transmission line induces a coupled signal for propagating along the second transmission line;

a quarter-wave, short circuited transmission line coupled to the thru port; and a half-wave, open circuited transmission line coupled to the isolation port, the half-wave line and the quarter-wave line increasing the bandwidth of the directional coupler.

8. A compensated backward-wave broadband directional coupler comprising:

a first transmission line defining an input port and having a thru port on one side of the coupler;

a second transmission line defining a coupled port and an isolation port and positioned adjacent to the first transmission line, the isolation port on a side of the coupler opposite from the thru port, whereby a signal propagating along the first transmission line induces a coupled signal for propagation along the second transmission line;

a quarter-wave lumped constant equivalent network having an impedance equal to a quarter-wave, short circuited transmission line, said network coupled to the thru port; and a half-wave lumped circuit equivalent network having an impedance equal to a half-wave, open circuited transmission line, said half-wave network coupled to the isolation port, the quarter-wave and half-wave equivalent networks coupled to opposite sides of the coupler thereby increasing the bandwidth of the directional coupler.

9. The broadband directional coupler of claim 8, wherein the quarter-wave lumped constant equivalent network comprises a $\pi$ lumped constant equivalent network.

10. The broadband directional coupler of claim 8, wherein the quarter-wave lump constant equivalent network comprises a T-shaped lumped constant equivalent network.

11. The broadband directional coupler of claim 8, wherein the half-wave lumped constant equivalent network comprises a cascaded pair of $\pi$-shaped lumped constant equivalent networks.

12. The broadband directional coupler of claim 8, wherein the half-wave lumped constant equivalent network comprises a cascaded pair of T-shaped lumped constant equivalent networks.

* * * * *